US009915427B2

(12) United States Patent
Antxia Uribetxeberria

(10) Patent No.: US 9,915,427 B2
(45) Date of Patent: Mar. 13, 2018

(54) DUAL FUEL PILOT LIGHT BURNER

(71) Applicant: COPRECITEC, S.L., Aretxabaleta (ES)

(72) Inventor: Jose Joaquin Antxia Uribetxeberria, Aretxabaleta (ES)

(73) Assignee: COPRECI, S. COOP., Artexbaleta (ES)

( * ) Notice: Subject to any disclaimer, the term of this patent is extended or adjusted under 35 U.S.C. 154(b) by 842 days.

(21) Appl. No.: 14/303,533

(22) Filed: Jun. 12, 2014

(65) Prior Publication Data

US 2014/0370449 A1 Dec. 18, 2014

(51) Int. Cl.

| | |
|---|---|
| ***F23Q 3/00*** | (2006.01) |
| ***B66F 3/44*** | (2006.01) |
| ***F23Q 9/00*** | (2006.01) |

(52) U.S. Cl.

CPC ..... *F23Q 3/008* (2013.01); *B66F 3/44* (2013.01); *F23Q 9/00* (2013.01)

(58) Field of Classification Search

CPC ..... F23D 14/04; F23D 14/06; F23D 14/10; F23D 14/105; F23Q 9/04

USPC ..... 431/264, 354, 355; 126/226–228, 253, 126/401–414

See application file for complete search history.

(56) References Cited

U.S. PATENT DOCUMENTS

| | | | | |
|---|---|---|---|---|
| 612,959 | A * | 10/1898 | Wilson | F23D 14/48 431/355 |
| 723,667 | A * | 3/1903 | Grossmann | F23D 14/48 137/625.29 |
| 2,048,260 | A | 7/1936 | Guhl | |
| 2007/0277812 | A1 | 12/2007 | Deng | |
| 2010/0095945 | A1 | 4/2010 | Manning | |

FOREIGN PATENT DOCUMENTS

| | | | |
|---|---|---|---|
| GB | 191501944 | A | 1/1916 |
| WO | 2011134725 | A2 | 11/2011 |

OTHER PUBLICATIONS

Spanish Search Report, Spanish Application No. 201330885, issued by the Spanish Patent Office, dated Nov. 17, 2014, Madrid Spain. Partial English Translation of the Spanish Search Report (cited above; translated p. 5 of 6). Spanish Application No. 201330885, issued by the Spanish Patent Office, dated Nov. 17, 2014, Madrid Spain.

* cited by examiner

*Primary Examiner* — Vivek Shirsat

(74) *Attorney, Agent, or Firm* — Edell, Shapiro & Finnan, LLC

(57) ABSTRACT

A dual pilot light burner assembly suitable for working with a first type of gas or a second type of gas. According to one implementation the assembly includes a support, a regulating sleeve having a first nozzle, an air and gas mixing and intake chamber, and an injector having a second nozzle. The regulating sleeve is moveable with respect to the injector for placing the first supply nozzle in a first position with respect to the second supply nozzle for the delivery of the first type of gas to the pilot nozzle. The regulating sleeve moveable with respect to the injector for placing the first supply nozzle in a second position with respect to the second supply nozzle for the delivery of the second type of gas to the pilot nozzle. The regulating sleeve including structure accessible by an external tool and capable of receiving an end of the tool for use in moving the regulating sleeve between the first and second positions.

16 Claims, 8 Drawing Sheets

DUAL FUEL PILOT LIGHT BURNER

CROSS-REFERENCE TO RELATED APPLICATIONS

This application relates to and claims the benefit and priority to Spanish Patent Application No. P201330885, filed Jun. 14, 2013.

TECHNICAL FIELD

The present invention relates to a dual pilot light burner suitable for dual household appliances which can be supplied with gaseous fuels of several types, particularly natural gas (NG) or liquefied gas (LPG).

BACKGROUND

Household appliances such as stoves including dual pilot light burners are known in the state of the art.

Pilot light burners are used to control turning on gas burners in a household appliance and for monitoring the flame of the burners. These pilot light burners comprise a gas inlet, a sleeve with a nozzle to provide an outlet for the gas, a chamber in fluid communication with the injector where the air and gas is mixed according to the type of gas used, and a burner head where the combustion of the mixture takes place, the burner head being adjacent to the gas burner in the household appliance. However, users commonly use different types of gas, natural gas (NG) and liquefied gas (LPG) being the most common. The pilot light burner is manufactured based on one type of gas, and if the user has any other type of gas in their home, parts in the pilot light burner must be changed in order to adapt it to the latter type of gas.

WO2011134725 A2 describes a pilot light burner, suitable for working with gaseous fuels of several types, particularly natural gas (NG) or liquefied gas (LPG), comprising a support, a regulating sleeve comprising a first supply nozzle to supply gas, an air and gas mixing and intake chamber in fluid communication with the regulating sleeve, and an injector operatively cooperating with the regulating sleeve, comprising a second supply nozzle to supply gas, the second nozzle being able to be located with respect to the first nozzle in a first position for supplying a first gas, and a second position for supplying a second gas.

SUMMARY OF THE DISCLOSURE

According to some implementations, a dual pilot light burner suitable for working with gaseous fuels of several types, such as for example, natural gas (NG) or liquefied gas (LPG), is provided that comprises a support, a regulating sleeve comprising a first supply nozzle to supply gas, an air and gas mixing and intake chamber in fluid communication with the regulating sleeve, and an injector operatively cooperating with the regulating sleeve, the injector comprising a second supply nozzle to supply gas, the second nozzle being able to be located with respect to the first nozzle in a first position for supplying a first gas, and a second position for supplying a second gas. In order to adapt the pilot light burner to one of the first and second gases the regulating sleeve is operated with a tool directly from outside pilot light burner to move the regulating sleeve and arranging the second nozzle in the first or second position with respect to the first nozzle.

The dual pilot light burner allows changing the type of gas without changing any parts and using a simple tool, such as, for example, a screwdriver from outside the burner. Unlike the dual pilot light burners of the state of the art, the pilot light burner does not require any intermediate actuation means incorporated in the pilot light burner assembly, but rather it is the very tool acting directly on the regulating sleeve, causing the movement thereof, and the movement to at least two possible positions regulates one type of gas or the other. An easy-to-operate dual pilot light burner is thus obtained with a minimum number of parts, and both the assembly time of the burner and its final cost are therefore reduced.

These and other advantages and features will become evident in view of the drawings and the detailed description.

DETAILED DESCRIPTION

Figure 1:
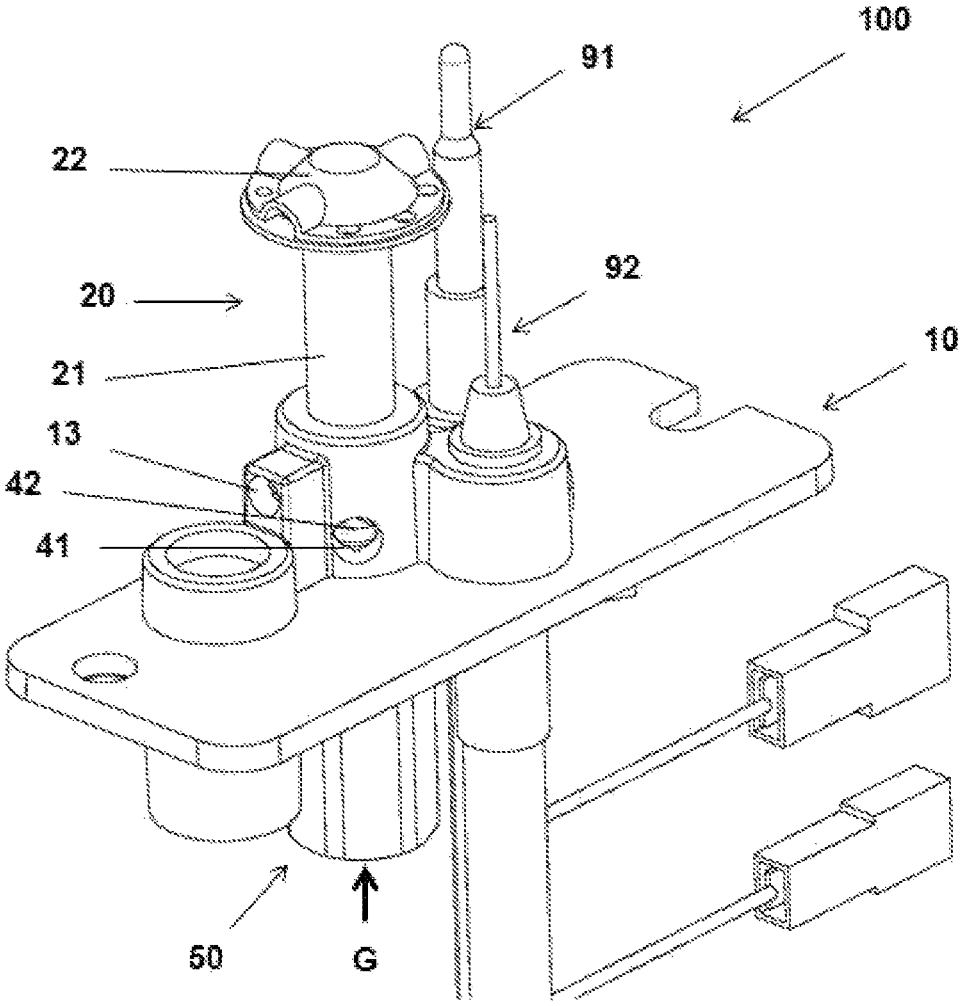
FIG. 1 shows a perspective view of a first embodiment of a dual pilot light burner.
Figure 2:
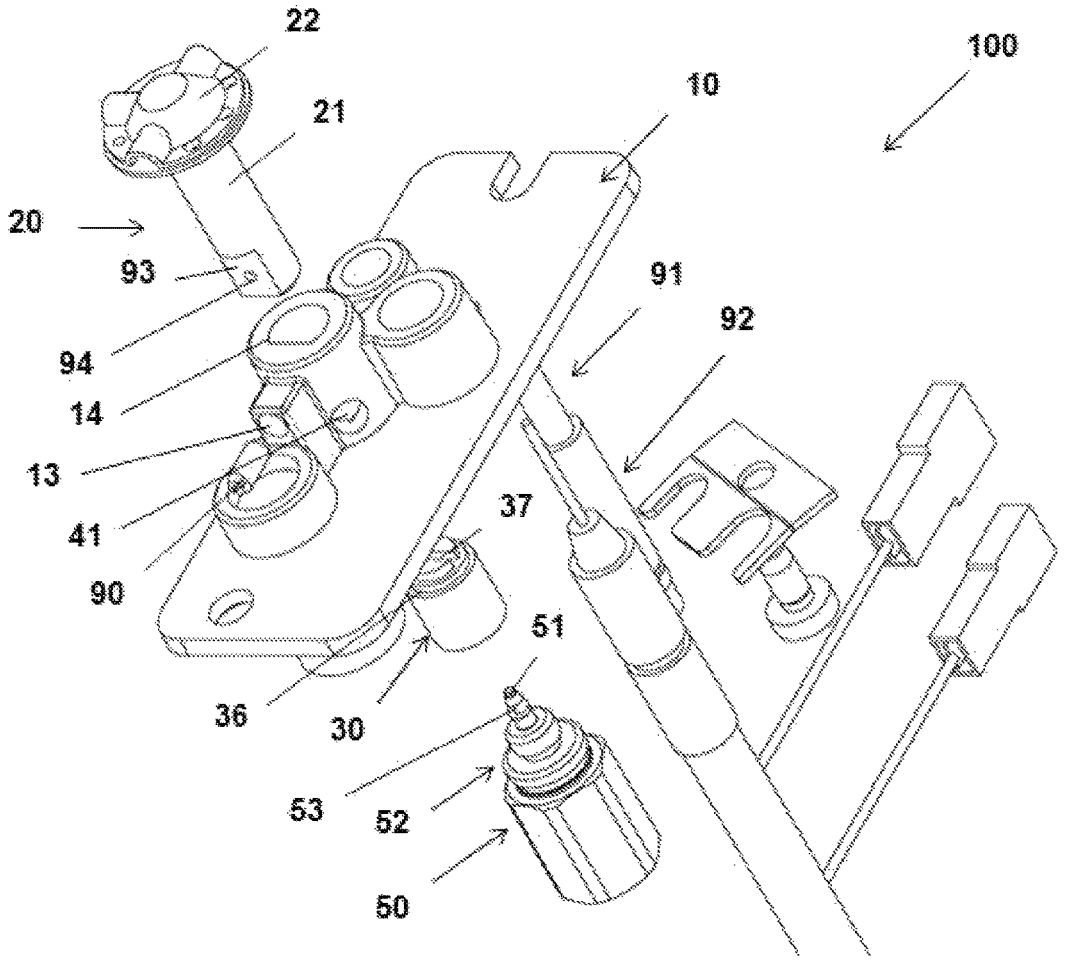
FIG. 2 is an exploded perspective view of the dual pilot light burner of FIG. 1.

FIG. 1 shows a perspective view of a first embodiment of a dual pilot light burner 100. FIG. 2 is an exploded perspective view of the dual pilot light burner of FIG. 1.

The dual pilot light burner 100 for a household appliance, such as a stove for example, is suitable for working with gaseous fuels of several types, such as, for example, natural gas (NG) or liquefied gas (LPG). The dual pilot light burner 100 comprises a support 10 with a plurality of housings in which different elements of the burner 100 can be arranged. In the embodiment of the dual pilot light burner shown in FIGS. 1, and 2, there are arranged in the support 10 a regulating sleeve 30, an injector 50, a burner head 20, the burner head 20 comprising a tubular duct 21 that is removably attached to the support 10, and a pilot light nozzle 22 attached to an end of the tubular duct 21, a safety thermocouple 91, and a spark generator 92 such as a spark plug.

Figure 3:
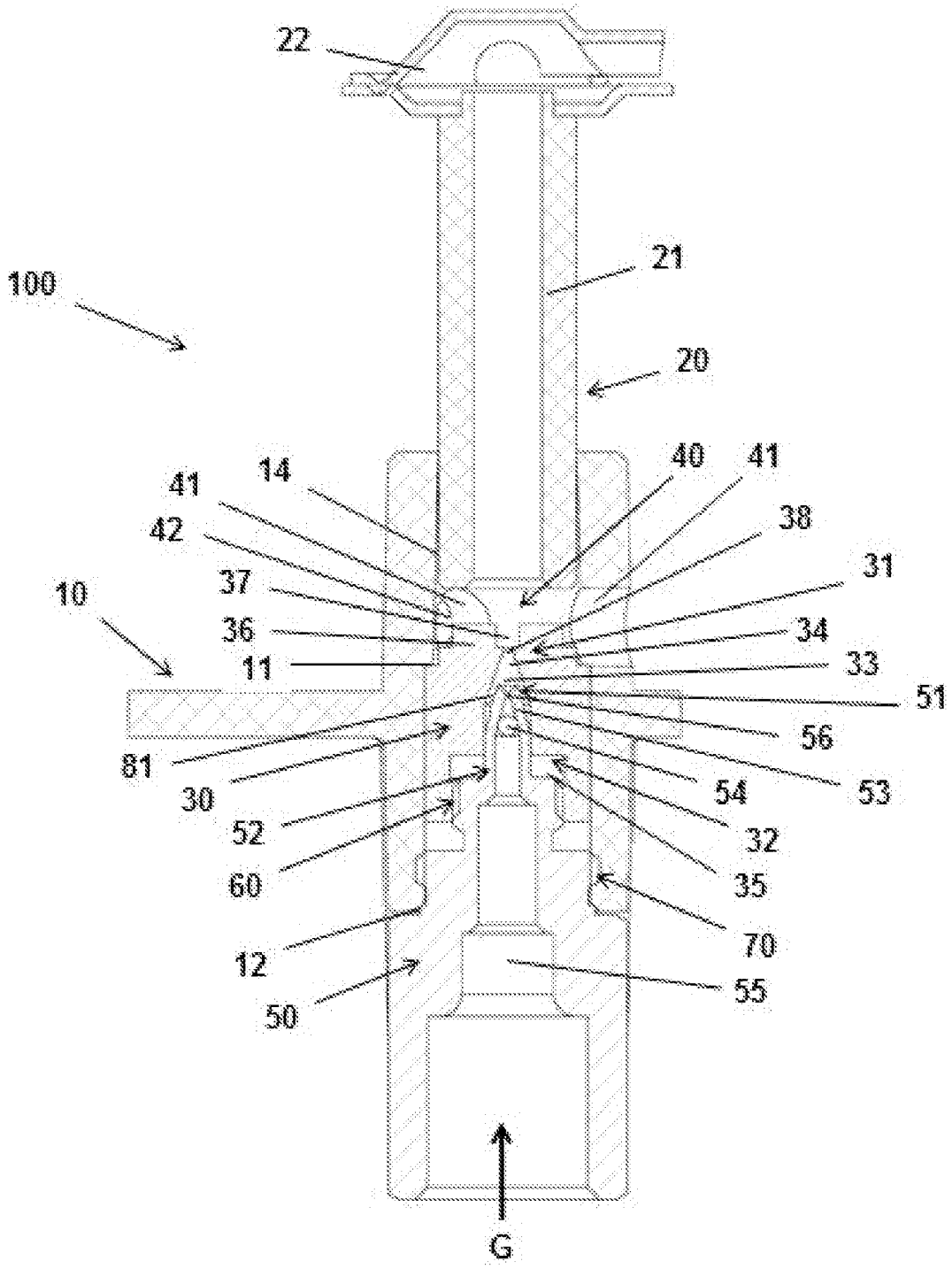
FIG. 3 is an axial section view of the dual pilot light burner of FIG. 1 regulated for natural gas (NG).
Figure 4:
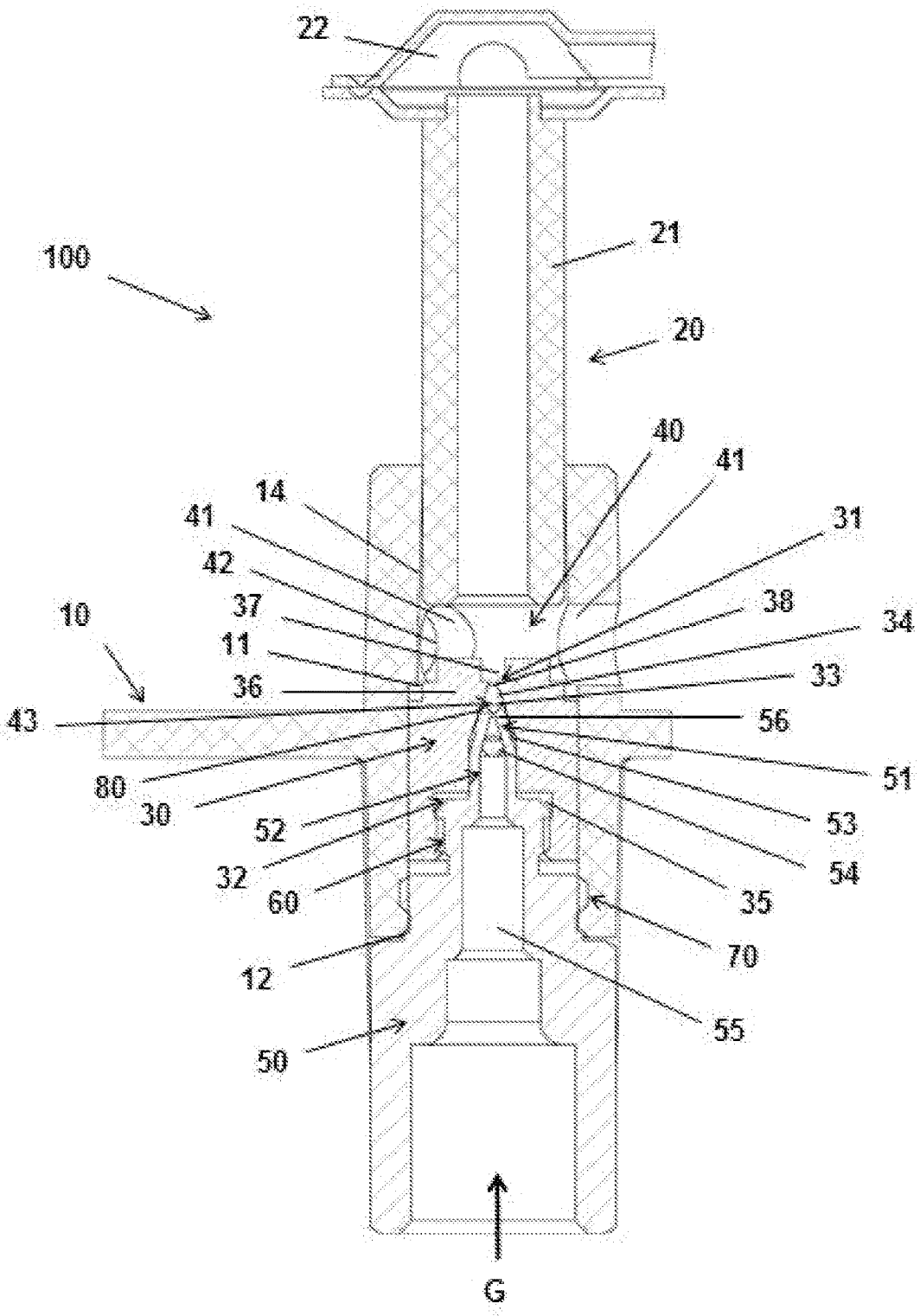
FIG. 4 is an axial section view of the dual pilot light burner of FIG. 1 regulated for liquefied gas (LPG).

FIG. 3 is an axial section view of the dual pilot light burner of FIG. 1 regulated for natural gas (NG), and FIG. 4 is an axial section view of the dual pilot light burner of FIG. 1 regulated for liquefied gas (LPG). The regulating sleeve 30 comprises a first supply nozzle 31 to supply a first gas at one end, and the support 10 comprises an air and gas mixing and intake chamber 40 which is in fluid communication with the regulating sleeve 30 through the first nozzle 31. The injector 50 comprises a second nozzle 51 at one end which allows the supply of a second gas. Both parts, the regulating sleeve 30 and the injector 50, are operatively cooperating such that the nozzles 31 and 51 can be positioned relative to one another. Therefore, the second nozzle 51 can be positioned with respect to the first nozzle 31 in a first position in which the gas flow supplied to the air and gas mixing and intake chamber 40 is defined through the first nozzle 31, and the second nozzle 51 can also be positioned in a second position in which the gas flow supplied to the air and gas mixing and intake chamber 40 is defined through the second nozzle 51, the first nozzle 31 having no effect on the gas supply in the second position. Once the gas is taken into the chamber 40, it is mixed with air coming from the outside through a port 41, and the mixture is supplied to the burner head 20 which is in fluid communication with the air and gas mixing and intake chamber 40. The gas and air mixture is supplied to the pilot light nozzle 22 through the tubular duct 21, and combustion occurs.

With the configuration defined above, the dual pilot light burner 100 can be used with, for example, natural gas (NG) and with liquefied gas (LPG), natural gas (NG) being supplied through the first nozzle 31 and liquefied gas (LPG) being supplied through the second nozzle 51. To perform the regulation, the regulating sleeve 30 is movable and the injector 50 is fixed, the regulating sleeve 30 being able to be operated with a tool, such as a screwdriver for example, directly from the outside without the cooperation of intermediate actuation means between the regulating sleeve 30 and the injector 50. By moving the regulating sleeve 30, and with it also moving the first nozzle 31, the second nozzle 51 can be arranged in the first or second position, and natural gas (NG) or liquefied gas (LPG) can therefore be supplied with a simple operation, without changing any part, and with a minimum number of elements.

In the embodiment of the dual pilot light burner 100 shown in FIGS. 1-4, the support 10 is a molded aluminum part with a plurality of housings projecting from the surface of the support 10, wherein machining operations have been performed to thus allow locating the different elements of the burner 100 mentioned above. The burner head 20 is located in one of the housings, the tubular duct 21 being assembled from the upper portion of the support 10 through a port 14 made in the housing and going through the support 10. The air and gas mixing and intake chamber 40 is located inside the housing, in the port 14, which is a through hole. According to some implementations the chamber 40 comprises two air inlet ports 41, the ports 41 extending through a wall of the housing.

According to other embodiments, the housing that forms the port 14 is not molded as a single part with the support 10. In such embodiments the housing may constitute a separate part that is assembled on the support 10.

To make a correct air and gas mixture in the air and gas mixing and intake chamber 40 according to if the gas supply is natural gas (NG) or liquefied gas (LPG), the amount of air is different, being lower in the case of natural gas (NG) and greater in the case of liquefied gas (LPG). The dual pilot light burner 100 allows the differentiated air supply into the chamber 40 due to the movement of the regulating sleeve 30. The air regulation is performed when the regulating sleeve 30 is operated directly with a tool and is moved arranging the second nozzle 51 in the first or second position. As the regulating sleeve 30 is moved, the body of the regulating sleeve 30 interferes with the ports 41 of the chamber 40, defining a passage 42 in the port 41 which is lower in the first position corresponding to natural gas (NG) than in the second position corresponding to liquefied gas (LPG). Therefore, and while at the same time as setting the dual pilot light burner 100 to natural gas (NG) or to liquefied gas (LPG) with the movement of the regulating sleeve 30, the primary air needed in the air and gas mixing and intake chamber 40 is regulated.

The manner in which the regulating sleeve 30 and the injector 50 are placed and arranged to operatively cooperate in the embodiment illustrated in FIGS. 1-4 is described below. The injector 50 is a part with a central body, the outer surface of may be substantially polyhedral and the inside of which may be substantially cylindrical. According to some implementations the injector has a substantially conical-shaped end 52 projecting from an upper end of the central body, and in the outlet vertex 53 of which the second nozzle 51 is arranged. There is formed inside the injector 50 an inner duct 55 allowing fluid communication between a lower end of the injector 50 where the external gas G inlet is formed and the second nozzle 51. To assemble the injector 50 in the support 10, the injector 50 has a lower threaded area, and the port 14 also has a threaded area in its lower area, these threaded areas defining attachment means 70 between the injector 50 and the support 10 when they are attached to one another.

The regulating sleeve 30 may be a substantially cylindrical part comprising an inner duct 32. The inner duct 32 in turn comprises a lower chamber 35 and an upper chamber 33, the upper chamber 33, according to some implementations being substantially conical-shaped. The upper chamber 33 is in fluid communication with the air and gas mixing and intake chamber 40 when the regulating sleeve 30 is assembled in the pilot light burner 100. The first nozzle 31 of the regulating sleeve 30 is arranged at an upper end 36 of the regulating sleeve 30, in an outlet vertex 34 of the upper chamber 33.

The support 10 comprises at its through port 14 a certain diameter in the upper inlet area of the support 10, and in the air and gas mixing and intake chamber 40 the port 14 increases in diameter, a horizontal internal wall which is a stop 11 being formed. The regulating sleeve 30 comprises a threaded area in the lower portion of the lower chamber 35, in the wall thereof, and the injector 50 has at its end 52 and above the lower threaded area for attachment with the support 10, an upper threaded area, these threaded areas defining attachment means 60 when they are attached to one another. The regulating sleeve 30 is arranged on the injector 50, the threaded area of the lower chamber 35 of the regulating sleeve 30 is attached to the upper threaded area of the injector 50, and the regulating sleeve 30 and the injector 50 are thus attached to one another.

Once the regulating sleeve 30 is assembled in the injector 50, the assembly is located in the housing of the support 10 where the burner head 20 is located. The regulating sleeve 30 and injector 50 assembly is assembled in a fixed manner in the housing from the lower portion of the support 10 and through the through port 14 from the larger diameter. The injector 50, with the regulating sleeve 30 incorporated therein, is located inside the housing of the support 10, the lower threaded area of the injector 50 is attached to the threaded area of the through hole 14 forming the attachment means 70, the injector 50 being able to move in the support 10 until the injector 50 is located on a stop 12 of the support 10. The injector 50 is thus permanently fixed in the support 10.

The regulating sleeve 30, which is attached to the injector 50 by attachment means 60, can move in the axial direction of the port 14 of the support 10 in both directions, and therefore both the regulating sleeve 30 and the injector 50 are operatively cooperating. The movement in both directions has stops, such that when one of the natural gas (NG) or liquefied gas (LPG) is to be regulated, the regulating sleeve 30 is operated with the tool turning which is capable of turning the regulating sleeve 30 in both directions. By turning the regulating sleeve 30 in the direction of opening with respect to the injector 50, as the injector 50 is fixed in the support 10, the regulating sleeve 30 moves in the threaded attachment 60 until the upper end 36 of the regulating sleeve 30 contacts the stop 11 of the support 10. By turning the regulating sleeve 30 in the direction of closing with respect to the injector 50, the regulating sleeve 30 moves in the threaded attachment 60 until the inner surface of the upper chamber 33 of the regulating sleeve 30 contacts the outer surface of the outlet vertex 53 of the end 52 of the injector 50. The outlet vertex 53 and the upper chamber 33 may be substantially conical-shaped surfaces, but in this embodiment the conical-shaped surfaces have a different trailing angle, so contact between both surfaces occurs in a contact area 80 in a portion of each of the surfaces along the entire periphery thereof.

The regulating sleeve 30 can thus move inside the support 10 in a path located between the stop 11 with the support 10 in the upper area, and the contact area 80 with the injector 50 in the lower area. The stop 11 and the contact area 80 are positions corresponding to the first position and to the second position of the second nozzle 51. The dual pilot light burner 100 can thus be regulated for natural gas (NG) or liquefied gas (LPG) in a simple manner by simply moving the regulating sleeve 30 directly with a tool against a contact area 80 and against a stop 11, respectively. With this configuration of the dual pilot light burner 100, the regulating sleeve 30 and the injector 50 are arranged coaxially with respect to one another, and in turn the assembly formed by both is arranged coaxially with respect to the port 14 of the support 10.

Figure 5:
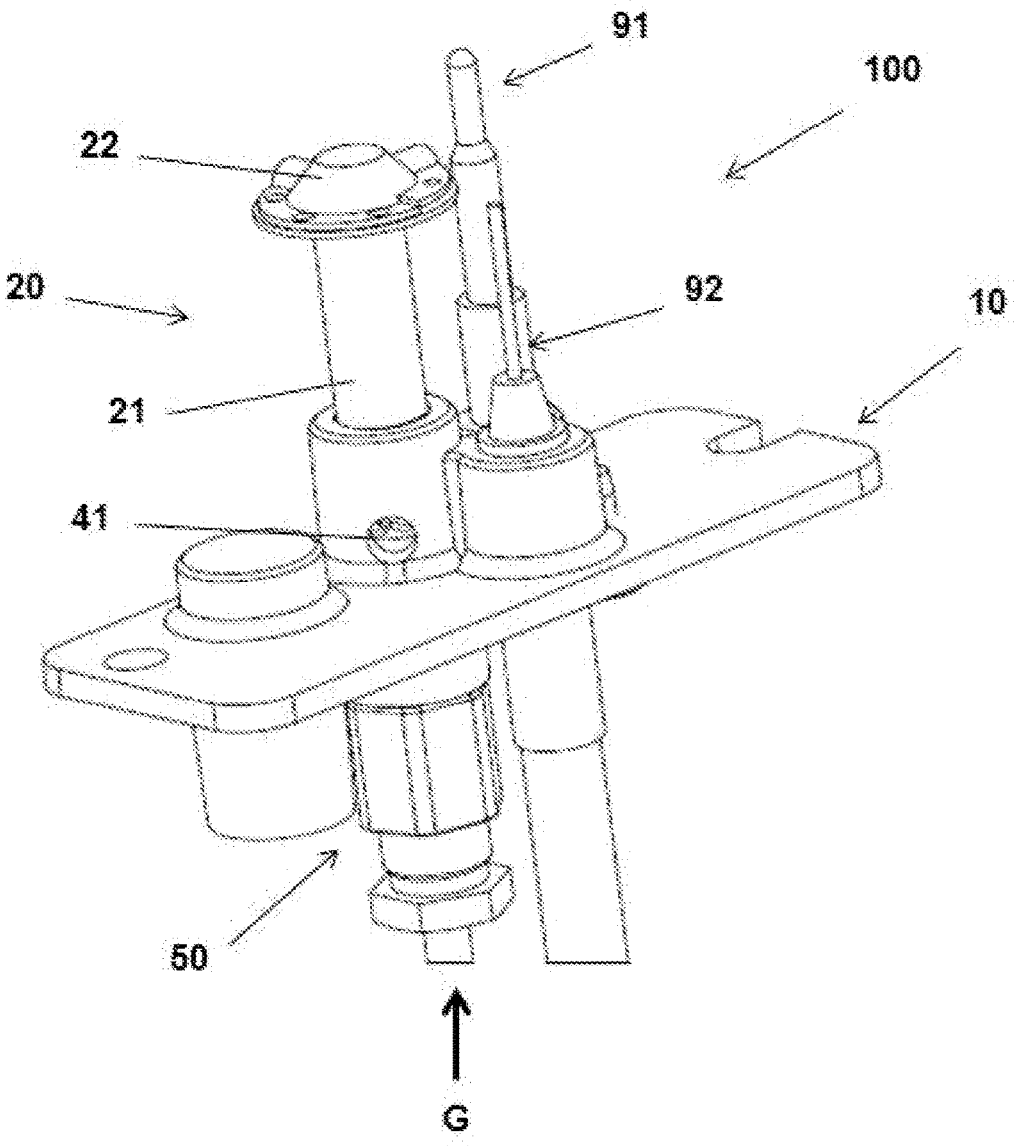
FIG. 5 shows a perspective view of a second embodiment of a dual pilot light burner.
Figure 6:
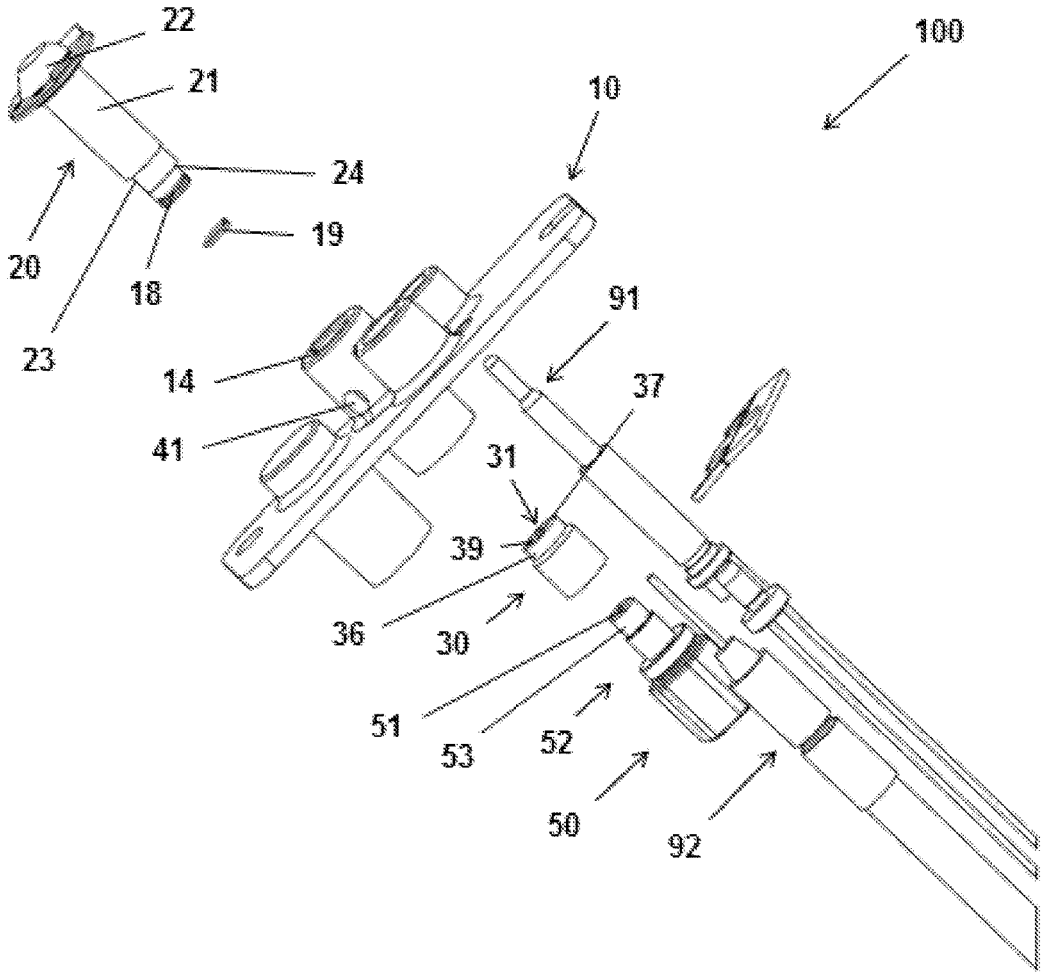
FIG. 6 is an exploded perspective view of the dual pilot light burner of FIG. 5.
Figure 7:
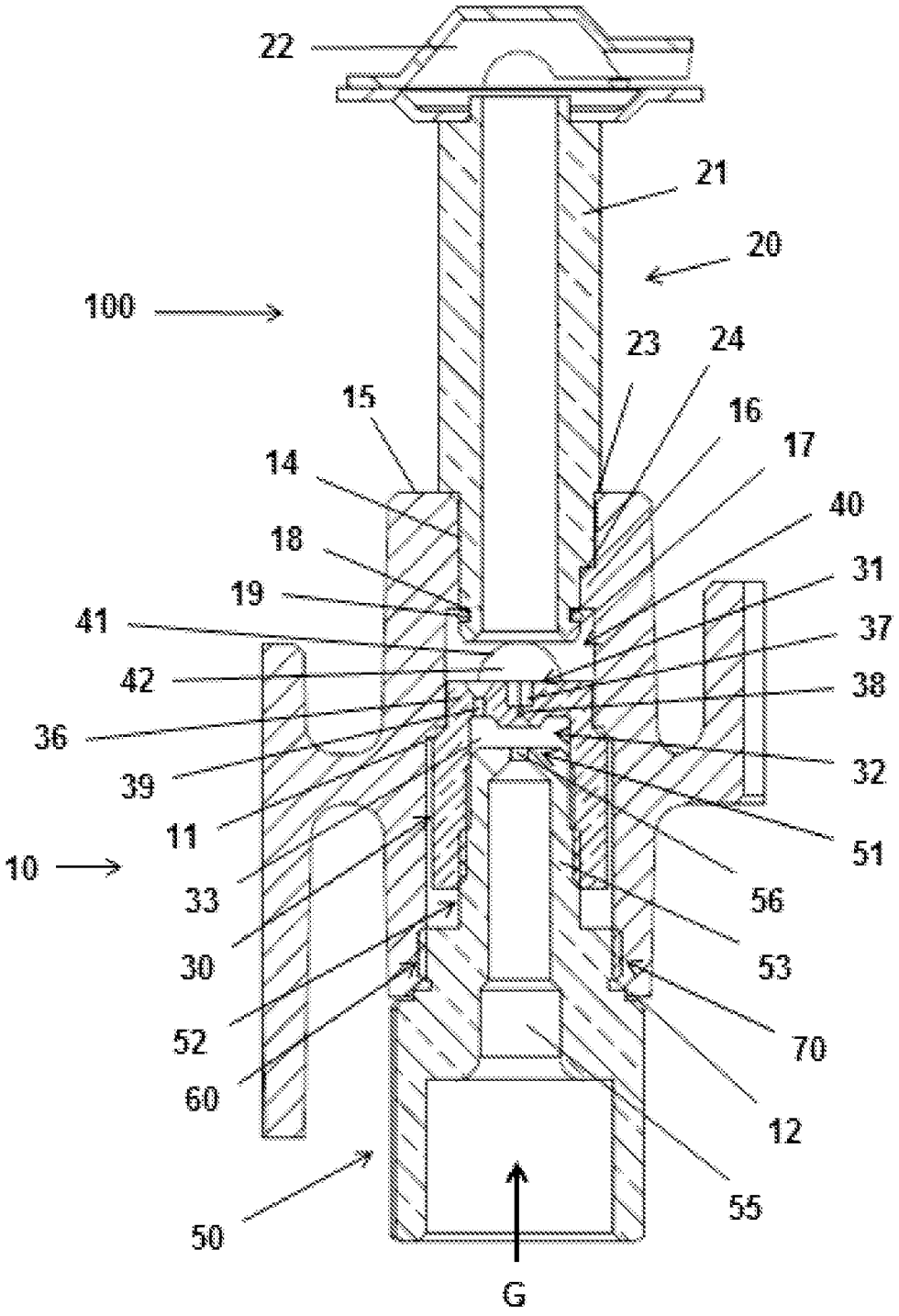
FIG. 7 is an axial section view of the dual pilot light burner of FIG. 5 regulated for natural gas (NG).
Figure 8:
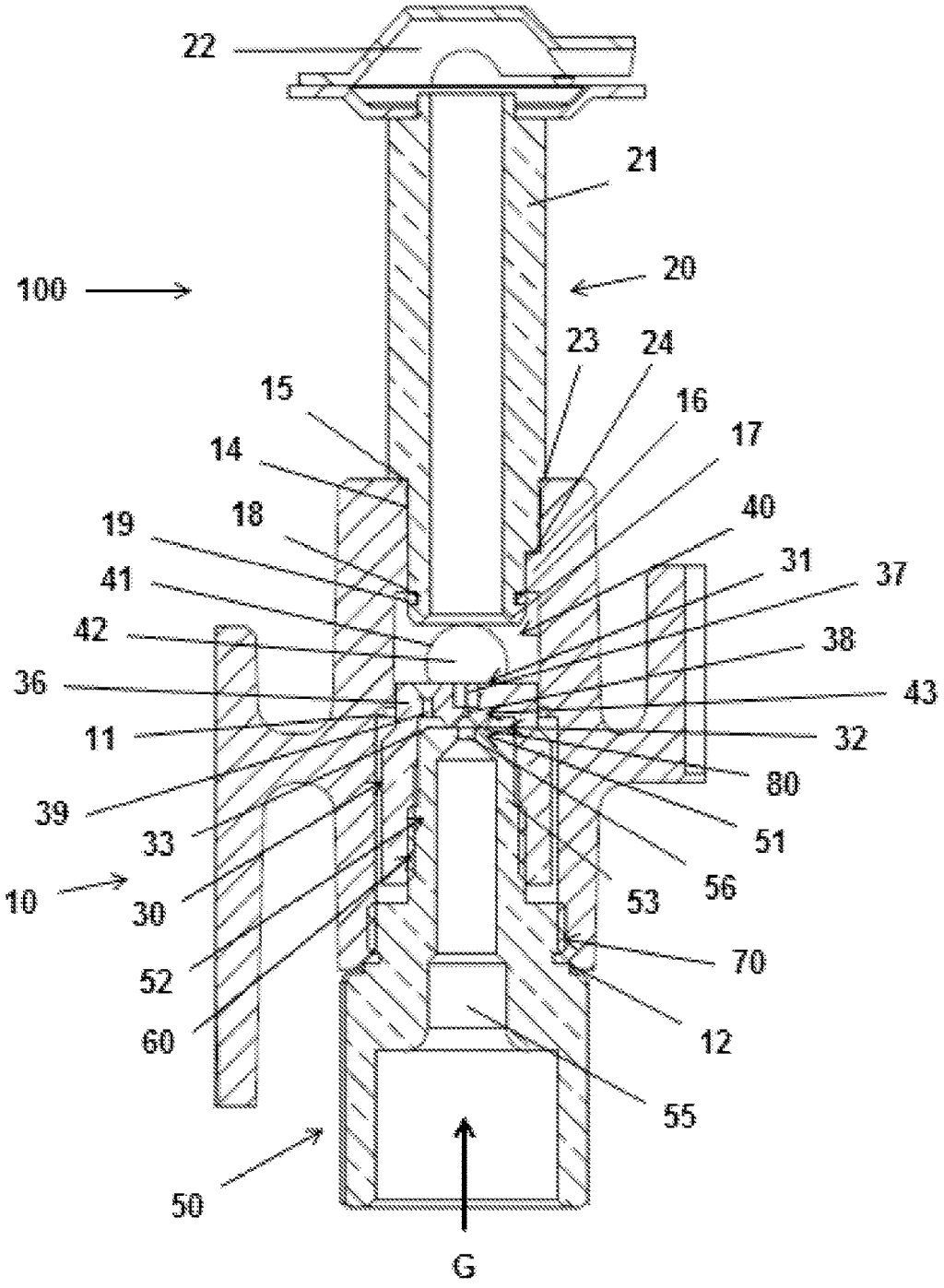
FIG. 8 is an axial section view of the dual pilot light burner of FIG. 5 regulated for liquefied gas (LPG).

FIGS. 5-8 show a second embodiment of the dual pilot light burner. FIG. 5 shows a perspective view of a second embodiment of a dual pilot light burner. FIG. 6 is an exploded perspective view of the dual pilot light burner of FIG. 5. FIG. 7 is an axial section view of the dual pilot light burner of FIG. 5 regulated for natural gas (NG), and FIG. 8 is an axial section view of the dual pilot light burner of FIG. 5 regulated for liquefied gas (LPG). The features of the dual pilot light burner of this second embodiment, are similar to those of the dual pilot light burner of the first embodiment with differences that are described below.

The second nozzle 51 can be positioned with respect to the first nozzle 31 in a first position, in which the gas flow supplied to the air and gas mixing and intake chamber 40 is defined through the first nozzle 31, and the second nozzle 51 can also be positioned in a second position, in which the gas flow supplied to the air and gas mixing and intake chamber 40 is defined also through the first nozzle 31, the second nozzle 51 having no effect on the gas supply in the second position.

As shown in FIGS. 6, 7 and 8, the injector 50 is a part with a central body, the outer surface of which may be substantially polyhedral and the inside of which may be substantially cylindrical. The injector 50 has an end 52 projecting from the upper end of the central body which may be substantially cylindrical-shaped. In an outlet vertex 53 of the injector 50 there is arranged the second nozzle 51. The regulating sleeve 30 may be a substantially cylindrical part comprising an inner duct 32. The inner duct 32 in turn comprises, in its upper area near to the air and gas mixing and intake chamber 40, an upper chamber 33, the upper chamber 33 being, according to some implementations being substantially cylindrical-shaped. The regulating sleeve 30 comprises a threaded area in its lower portion, in a wall thereof, and the injector 50 has at its end 52, and above the lower threaded area for attachment with the support 10, an upper threaded area, these threaded areas defining attachment means 60 when they are threaded together.

When the natural gas (NG) or liquefied gas (LPG) dual pilot light burner 100 is to be regulated, the regulating sleeve 30 is operated with the tool that is capable of turning the regulating sleeve in both directions. By turning the regulating sleeve 30 in the direction of opening with respect to the injector 50, as the injector 50 is fixed in the support 10, the regulating sleeve 30 moves in the threaded attachment 60 until the upper end 36 of the regulating sleeve 30 contacts the stop 11 of the support 10. By turning the regulating sleeve 30 in the direction of closing with respect to the injector 50, the regulating sleeve 30 moves in the threaded attachment 60 until the inner surface of the upper chamber 33 of the regulating sleeve 30 contacts the outer surface of the outlet vertex 53 of the end 52 of the injector 50. The outlet vertex 53 and the upper chamber 33 may be substantially flat-shaped surfaces, but in this embodiment the conical-shaped surfaces have a different trailing angle, so contact between both surfaces occurs in a portion of each of the surfaces, that is the contact area 80.

In the first embodiment of the dual pilot light burner 100, as shown in FIGS. 3 and 4, the first nozzle 31 comprises a gas supply hole 38, and the second nozzle 51 comprises an injection hole 56. The injector 50 comprises at its end 52 one or more holes 54. When the regulating sleeve 30 is positioned as shown in FIG. 3 for the delivery of natural gas (NG), the holes 54 communicate the inner duct 55 of the injector 50 with the duct 43 defined between the first nozzle 31 and the injector 50. When the regulating sleeve 30 is assembled in the injector 50, the end 52 of the injector 50 is housed in the inner duct 32 of the regulating sleeve 30, forming a gap 81 between the outer surface of the end 52 and the inner surface of the inner duct 32. When the regulating sleeve 30 contacts the injector 50 in the contact area 80, the holes 54 are located before the contact area 80 in the direction of the gas flow.

When the dual pilot light burner 100 is set to natural gas (NG), and therefore the second nozzle 51 is located in the first position, the gas G introduced through the lower end of the injector 50 flows through the inner duct 55 and exits through both the injection hole 56 and through the holes 54 of the injector 50. These gas flows are capable of finally exiting together through gas supply hole 38 of the first nozzle 31 of the regulating sleeve 30, since the diameter of the gas supply hole 38 is greater than the diameter of the injection hole 56 of the second nozzle 51. The gas flow towards the air and gas mixing and intake chamber 40 is therefore defined, in this first position of the second nozzle 51 corresponding to natural gas (NG), by the gas supply hole 38.

When the dual pilot light burner 100 is set to liquefied gas (LPG), and therefore the second nozzle 51 is located in the second position, the regulating sleeve 30 contacts the injector 50 in the contact area 80. In this situation, the gas introduced through the lower end of the injector 50 and flowing through the inner duct 55, can only exit through the injection hole 56 of the second nozzle 51, since the holes 54 are located below the contact area 80 in the direction of the gas flow. As explained above, duct 43 is defined between the first nozzle 31 and the injector 50, specifically a path is defined, through which the gas flows, linking the injection hole 56 and the gas supply hole 38. Since the diameter of the injection hole 56 is smaller than the diameter of the gas supply hole 38, the gas flow exits through the gas supply hole 38 of the first nozzle 31 towards the air and gas mixing and intake chamber 40, the gas flow in this second position of the second nozzle 51 therefore being defined by the injection hole 56.

In the second embodiment of the dual pilot light burner 100, as shown in FIGS. 7 and 8, the first nozzle 31 comprises the gas supply hole 38, and at least a second gas supply hole 39, and the second nozzle 51 comprises the injection hole 56. The first gas flow corresponding to natural gas (NG), supplied to the air and gas mixing and intake chamber 40, is defined by the amount of gas flow passing through the gas supply hole 38 and the second gas supply hole 39 of the first nozzle 31, corresponding to the first position of the second nozzle 51, as shown in FIG. 7. The injection hole 56 has a sufficient diameter to give way to natural gas flow (NG), the gas supply hole 38 and the second gas supply hole 39 being which define the natural gas flow (NG).

The second gas flow corresponding to liquefied gas (LPG), supplied to the air and gas mixing and intake chamber 40, is defined by the duct 43, defined in this second embodiment by the path that links the gas supply hole 38 of the first nozzle 31, and the injection hole 56 of the second nozzle 51, corresponding to the second position of the second nozzle 51, as shown in FIG. 8, the regulating sleeve 30 being displaced until it makes contact with the injector 50 at contact area 80. The diameter of the gas supply hole 38 is smaller than the diameter of the injection hole 56, the gas supply hole 38 defining the liquefied gas flow (LPG).

According to some implementations of the first and second embodiments, the burner head 20 is assembled once the injector 50 and the regulating sleeve 30 are assembled in the support 10. To that end, the tubular duct 21 is first introduced in the port 14 of the support 10, and the pilot light nozzle 22 is then assembled at the end of the tubular duct 21.

In the first embodiment of the dual pilot light burner 100, as shown in FIGS. 1 and 2, to enable fixing the tubular duct 21 to the support 10, the support 10 comprises an additional port 13 in a housing adjacent to the housing where the regulating sleeve 30, the injector 50, and the tubular duct 21 are located. This additional port 13 is substantially horizontal and communicates the outside with the port 14 of the support 10, both ports 13 and 14 being substantially perpendicular with respect to one another. Fixing means 90, a clamping screw for example, is housed in the additional port 13 such that it allows fixing the tubular duct 21 when it is housed in the port 14. To establish the position of the tubular duct 21 in the port 14, the tubular duct 21 comprises along the periphery thereof a planar area 93 with a notch 94 therein, and the port 14 has the same shape as the tubular duct 21 along the periphery thereof. The tubular duct 21 is thus positioned in the port 14 of the support 10, and the fixing means 90 clamp the tubular duct 21 with the end thereof in the notch 94 of the planar area 93 of the tubular duct 21.

In the second embodiment of the dual pilot light burner 100, as shown in FIGS. 5-8, to enable fixing the tubular duct 21 to the support 10, the tubular duct 21 of the burner head 20 has a cylindrical shape and comprises a first protrusion 23 that fits in the outer surface of one end 15 of the port 14 of the support 10. The tubular duct 21 also comprises a second protrusion 24 which fits in an internal protrusion 16 of the port 14, the internal protrusion 16 being located between the air and gas mixing and intake chamber 40 and the end 15 of the port 14. Close to a lower end 17 of the tubular duct 21, is a peripheral groove 18, the lower end 17 being located, when the tubular duct 21 is fixed to the support 10, between the air and gas mixing and intake chamber 40 and the second protrusion 24 of the tubular duct 21. A washer 19 is arranged in the groove 18, which is for example a metal C-shaped washer with a circular section. When the tubular duct 21 is assembled to the support 10, the washer 19 is compressed, and the lower end 17 of the tubular duct 21 can pass through the second protrusion 24. And when the tubular duct 21 is disassembled from the support 10 with a small pull, the washer 19 is compressed, and allows the passage of the lower end 17, and thus the tubular duct 21. Thus, it can secure the tubular duct 21 to the support 10, by fitting the washer 19 in the bottom of the second protrusion 24.

When the injector 50 together with the regulating sleeve 30 and the burner head 20 are fixed in the support 10, the air and gas mixing and intake chamber 40 is formed in the gap comprised between the tubular duct 21 and the regulating sleeve 30, the primary air inlet ports 41 being arranged in the air and gas mixing and intake chamber 40.

To enable correctly operating the regulating sleeve 30 with the tool from the outside in setting the dual pilot light burner 100 to natural gas (NG) or to liquefied gas (LPG), the regulating sleeve 30 comprises an indentation 37 on the outer surface of its upper end 36 which allows coupling the tool thereto.

In the first embodiment of the dual pilot light burner 100 shown in FIGS. 1-4, the indentation 37 is a groove arranged at the outer surface of the end 36. The groove allows coupling the end of a tool, such as, for example, a flat-head screwdriver. The gas supply hole 38 of the first nozzle 31 of the regulating sleeve 30, that is located on the upper end 36 in the outlet vertex 34 of the upper chamber 33, has the outlet in the indentation 37.

In the second embodiment of the dual pilot light burner 100 shown in FIGS. 5-8, the indentation 37 is also a groove arranged on the outer surface of the end 36, the gas supply hole 30 having the outlet near the indentation 37.

However, other indentations at the end 36 of the regulating sleeve 30 are possible, such as a radial or star-shaped indentation, for example.

Once the dual pilot light burner 100 is assembled, when it is to be set to natural gas (NG) or to liquefied gas (LPG), in the first embodiment of the dual pilot light burner 100, the fixing means 90 is released, and the burner head 20 is removed, and in the second embodiment of the dual pilot light burner 100 the tubular duct 21 is pulled to remove the burner head 20. Then, the inside of the housing of the support 10 is accessed through the port 14 with the end of the tool. The end of the tool is coupled to the indentation 37 of the regulating sleeve 30 and it is turned in either direction either until the upper end 36 of the regulating sleeve 30 contacts the stop 11 of the support 10 in the case of setting to natural gas (NG), or until the inner surface of the upper chamber 33 of the regulating sleeve 30 contacts the outer surface of the outlet vertex 53 of the end 52 of the injector 50 at the contact area 80, in the case of setting to liquefied gas (LPG). The pilot light nozzle 22 can be a single-pilot or multi-pilot light nozzle corresponding to the number of burners served by the dual pilot light burner 100. In the case of a single pilot light, the pilot light nozzle 22 can have a port that is axial with respect to the tubular duct 21 (not depicted in the drawings), such that the burner head 20 would not have to be removed to set the pilot assembly to the different types of gas. In this case, the regulating sleeve 30 would be accessed with the tool directly through the tubular duct 21.

What is claimed is:

1. A dual pilot light burner assembly suitable for use with a first type of gas and a second type of gas, the assembly comprising:

a pilot nozzle adapted for providing a flame to a burner, an air and gas mixing and intake chamber, an injector having at or near a distal end an injection hole, the injector having an inner duct that extends from a proximal gas inlet to the distal end, the injector having one or more holes situated proximal to the injection hole; and a regulating sleeve located between the injector and air and gas mixing and intake chamber, the regulating sleeve including an inner duct with an upper chamber in fluid communication with the air and gas mixing and intake chamber via a gas supply hole located in a distal end of the upper chamber, the regulating sleeve moveable with respect to the injector for placing the gas supply hole in a first position with respect to the injection hole of the injector, when the regulating sleeve is in the first position the one or more holes of the injector and the injection hole are in fluid communication with the upper chamber of the regulating sleeve and the regulation of the first type of gas to the pilot nozzle is provided by the gas supply hole of the regulating sleeve, when the regulating sleeve is in the second position a portion of the distal end of the injector located between the injection hole and the one or more holes is in contact with a portion of the inner duct of the regulating sleeve and the regulation of the second type of gas to the pilot nozzle is provided by the injection hole of the injector, the gas supply hole of the regulating sleeve having a diameter that is greater than the diameter of the injection hole of the injector, the regulating sleeve comprising structure accessible by an external tool, the structure capable of receiving an end of the tool for use in moving the regulating sleeve between the first and second positions, wherein the structure accessible by the external tool is an indentation for the attachment of the tool, wherein the indentation is arranged on an outer surface of an upper end of the regulating sleeve, and wherein the indentation is located at the outlet of the gas supply hole.

2. An assembly according to claim 1, wherein the first type of gas is natural gas and the second type of gas is liquefied gas.

3. An assembly according to claim 1, wherein each of the distal end of the injector and the upper chamber of the regulating sleeve is conical-shaped.

4. An assembly according to claim 1, wherein the regulating sleeve and the injector operatively cooperate by a threaded engagement, the threaded engagement allowing an axial movement of the regulating sleeve in a first direction toward the first position and an axial movement of the regulating sleeve in a second direction opposite the first direction toward the second position.

5. An assembly according to claim 1, further comprising a support with a port, the pilot nozzle attached to a burner head having a tubular duct therein, the burner head removably attached to the support, the regulating sleeve, the injector and the tubular duct being assembled in an axial arrangement in the port of the support, the air and gas mixing and intake chamber being arranged in the port between the regulating sleeve and the tubular duct.

6. An assembly according to claim 5, wherein when in the first position a portion of the regulating sleeve is configured to abut a first stop located on the support.

7. An assembly according to claim 1, wherein the air and gas mixing and intake chamber comprises one or more air inlet ports that provide a passage for letting air into the air and gas mixing and intake chamber, the area of the passage being determined by the position of the regulating sleeve such that when the regulating sleeve is in the first position the passage comprises a first area and when the regulating sleeve is in the second position the passage comprises a second area that is greater than the first area.

8. A dual pilot light burner assembly suitable for use with a first type of gas and a second type of gas, the assembly comprising:

a pilot nozzle adapted for providing a flame to a burner, an air and gas mixing and intake chamber; and an injector having at a distal end an injection hole, the injector having an inner duct that extends from a proximal gas inlet to the distal end; and a regulating sleeve located between the injector and air and gas mixing and intake chamber, the regulating sleeve including an inner duct with an upper chamber in fluid communication with the air and gas mixing and intake chamber via first and second gas supply holes located at a distal end of the upper chamber, the regulating sleeve moveable with respect to the injector for placing the first and second gas supply holes in first and second positions with respect to the injection hole of the injector, when the regulating sleeve is in the first position the injection hole is in fluid communication with the upper chamber of the regulating sleeve and the regulation of the first type gas to the pilot nozzle is provided by the first and second gas supply holes of the regulating sleeve, when the regulating sleeve is in the second position a portion of the distal end of the injector contacts the regulating sleeve so that the injection hole of the injector is in direct abutment with the first gas supply hole of the regulating sleeve and the regulation of the second type of gas to the pilot nozzle is provided by the first gas supply hole of the regulating sleeve, the first gas supply hole of the regulating sleeve having a diameter that is less than the diameter of the injection hole of the injector, the regulating sleeve comprising structure accessible by an external tool, the structure capable of receiving an end of the tool for use in moving the regulating sleeve between the first and second positions.

9. An assembly according to claim 8, wherein the first type of gas is natural gas and the second type of gas is liquefied gas.

10. An assembly according to claim 8, wherein the regulating sleeve and the injector operatively cooperate by a threaded engagement, the threaded engagement allowing an axial movement of the regulating sleeve in a first direction toward the first position and an axial movement of the regulating sleeve in a second direction opposite the first direction toward the second position.

11. An assembly according to claim 8, further comprising a support with a port, the pilot nozzle attached to a burner head having a tubular duct therein, the burner head removably attached to the support, the regulating sleeve, the injector and the tubular duct being assembled in an axial arrangement in the port of the support, the air and gas mixing and intake chamber being arranged in the port between the regulating sleeve and the tubular duct.

12. An assembly according to claim 11, wherein when in the first position a portion of the regulating sleeve is configured to abut a first stop located on the support.

13. An assembly according to claim 8, wherein the air and gas mixing and intake chamber comprises one or more air inlet ports that provide a passage for letting air into the air and gas mixing and intake chamber, the area of the passage being determined by the position of the regulating sleeve such that when the regulating sleeve is in the first position the passage comprises a first area and when the regulating sleeve is in the second position the passage comprises a second area that is greater than the first area.

14. An assembly according to claim 8, wherein the structure accessible by the external tool is an indentation for the attachment of the tool.

15. An assembly according to claim 14, wherein the indentation is arranged on an outer surface of an upper end of the regulating sleeve.

16. An assembly according to claim 15, wherein the indentation is located at the outlet of the first gas supply hole.

* * * * *